United States Patent [19]

Vuksic

[11] Patent Number: 4,829,628

[45] Date of Patent: May 16, 1989

[54] SPRING BIASED HINGE HAVING A DAMPER AND A SLIDING PISTON

[76] Inventor: Zeljko B. Vuksic, Murta No. 28, 46020 Valencia, Spain

[21] Appl. No.: 65,068

[22] Filed: Jun. 19, 1987

[30] Foreign Application Priority Data

Jun. 25, 1986 [ES] Spain ..... 295448

[51] Int. Cl.[4] ..... E05F 3/20

[52] U.S. Cl. ..... 16/54; 16/299; 16/308; 16/DIG. 9

[58] Field of Search ..... 16/50, 54, 299, 300, 16/301, 305, 308, DIG. 9, DIG. 10

[56] References Cited

U.S. PATENT DOCUMENTS 1,824,217 9/1931 Kreiner ..... 16/54

2,127,327 8/1938 De Miller ..... 16/54

*Primary Examiner*—Fred A. Silverberg

*Attorney, Agent, or Firm*—Ladas & Parry

[57] ABSTRACT

The present invention covers a door hinge equipped with a damper spring, composed of two cylindrical bodies, kept in place by their anchor plates with the door, respectively the door frame. One of the cylindrical bodies forms a watertight chamber by way of sealing plugs, inside which a piston is mounted, held laterally in the cylinder by longitudinal guides which prevent the piston from rotating. Said piston has a threaded axial bore by which it is mounted on a journal with a wide screw pitch, the journal being the end of an axial shaft which passes through a central perforation in one of the sealing plugs of the watertight chamber. All this is so designed that the turning of the second cylindrical body of the hinge caused by its being fixed to the door by its respective anchor plate, creates a torsion stress in a spring, while at the same time turning the axial shaft in the watertight chamber filled with oil-hydraulic fluid.

11 Claims, 2 Drawing Sheets

SPRING BIASED HINGE HAVING A DAMPER AND A SLIDING PISTON

BACKGROUND OF THE INVENTION (1) Field of the Invention

This invention, for which the privilege of a patent is requested as indicated in these specification, consists of a perfected spring hinge with damper.

(2) Description of the Prior Art

At the present state of the art, various kinds of hinges are known which incorporate a braking device to check the closing of a door and which are generally formed by a cylindrical body from which project plates for fixation to the door and door frame. Their body is divided into two longitudinal chambers, oil passing from one chamber to the other through perforations, at least one of said chambers being equipped with a check valve which permits the fluid to pass one way only.

This kind of hinge has the severe disadvantage of having a complex structure which makes it difficult to manufacture and also involves large losses of oily fluid resulting in a deterioration of the normal function of said device.

SUMMARY OF THE INVENTION

Disclosed herein is a hinge assembly with means for attachment between a door and a door frame, said assembly containing damper means comprising:

a first body of cylindrical shape;

an axial shaft passing through said first body;

a coiled spring surrounding said axial shaft and generally attached to said first body;

a second body of cylindrical shape having a first end and a second end opposite said first end, said second body axially and rotatably anchored at said first end on said first body;

a hydraulic chamber for containing a hydraulic fluid, said chamber being positioned in said second body, said hydraulic chamber comprising a first closure cap disposed inside said second cylindrical body close to said first end, said first closure cap defining a first central perforation in its surface through which said axial shaft passes; and a second closure cap disposed inside and second cylindrical body near said second end; and piston means associated with said chamber and comprising a section slidably held within said chamber and a spindle generally attached to said axial shaft and threadably received in said section, said section defining at least one inlet hole in its surface such that the automatic closing motion of the door is dampered by the turning of said first body resulting in the decompression of said spring causing said axial shaft and therefore said spindle to turn this resulting in said section axially moving along the length of said chamber while being resisted by said hydraulic fluid, said hydraulic fluid passing through said inlet hole, said spindle comprising an axial retention ring rotatably mounted on said axial shaft where said shaft passes through said first central perforation of said first closure cap such that said ring acts as a pivot for said rotation of said first cylindrical body, at least one coupling mounted on said axial shaft next to 1 said retention ring;

at least one longitudinal guide located between said section and the interior of said second cylindrical body, such that said longitudinal guide hinders rotation of said section, said piston means further comprising at least one, unidirectional outlet bypass valve comprised of a ball and a generally open housing, such that during the opening motion of the door, said coiled spring is compressed forcing said shaft to turn and therefore said section to ascend and displace said hydaulic fluid by forcing it to pass through said outlet bypass valve; and a cylindrical bushing mounted on said axial shaft and providing anchoring means for said cylindrical bodies, said assembly, said cylindrical bushing facilitating oil tightness of said hinge assembly, complementing axial retention of said ring and providing anchoring means for said coiled spring surrounding said axial shaft by means of welding.

In order to eliminate the above-noted problems, the present invention brings to the market a new structural and functional configuration of a spring hinge with damper, the braking effect of which is provided by the axial displacement of a piston, due to turning of a central shaft under the action of a tension spring, said piston being displaced in a chamber full of oil-hydraulic fluid, the capacity of which can be adjusted, as can the tension of said spring, to change the closing speed of the door, to which effect the hinge incorporates special means for re-tightening of the spring in keeping with the working conditions of the door.

For this purpose, the spring hinge with damper is composed of two cylindrical bodies with their anchoring plates on the door or door frame.

One of said cylindrical bodies forms a water-tight chamber created by sealing end plugs. Inside of it, a piston is mounted, laterally held to the cylinder by longitudinal guides which prevent said piston from rotating.

Said piston has an threaded axial bore, with which is mounted on a wide-pitch spindle. Said spindle is the end of an axial shaft, which passes through a central perforation in one of the sealing plugs of the water-tight chamber.

Said perforation of the plug creates a seat for an axial retention ring of said shaft between watertight seals, said shaft crossing a cylindrical bushing, anchored on the outside of said plug by anchoring elements.

Said bushing acts simultaneously as additional watertight seal and axial retention of said shaft ring, as rotating journal of the second cylindrical body of the hinge, and as an ananchoring organ to which the end of a helicoidal spring, mounted coaxial with said shaft, is welded.

The opposite end of said spring is welded to the disk of a ring gear, the external toothing of which engages the inner surface of a sealing plug at the end of the second cylindrical body of said hinge, while the internal toothing of said ring gear effects a radial coupling with the grooved surface of a ring on the central shaft.

Said shaft passes through a wide axial perforation in the sealing plug, so that its threaded end passes through and extends from the central perforation of a second axially acting cap of the cylinder, where a nut provides retention and axial mounting of the second cylindrical body of said hinge against the journal of the first cylindrical body, and axial friction washer being inserted between the two.

All this is so designed that the turning of the second cylindrical body of said hinge, due to the fact that its plate is fixed to the door, creates a torsion stress in the spring, while at the same time turning the central shaft. This results in axial displaement in the water-tight chamber of the piston mounted in the first cylindrical body which thus fills with oil-hydraulic fluid.

Said piston has an axial check valve the opening of which coincides with the opening of the hinge, while during closing of the latter the valves are being closed by the pressure of the oil which slowly passes through some small perforations in the piston, thus checking the recovery of the tension spring.

To control the closing speed of the door, the hinge offers a regulation system for the capacity of the water-tight chamber as well as the possibility of regulating the tension of the torsion spring.

In the first case, the capacity of the watertight chamber is regulated by a plunger screwed into a central perforation of the sealing plug at the free end of the first cylindrical body, so that the volume of said chamber can be adjusted by turning the plunger in one sense or the other, to make the door close faster or more slowly.

For this purpose the design provides that the ring gear mounted in the second cylindrical body be equipped with an axial collar, faceted on the outside, which is lodged in the wide central perforation of the sealing plug, so that after removing the external nut and second cap, a socket wrench can be used which, after the spring has been axially compressed and of the ring gear turned, regulates the torsion tension of the spring in the new axial position of said ring gear.

To aid in the understanding of the idea discussed above, Included herewith is a set of drawings which show the object of this invention. However, said graphic representation shall not be construed to be a limitation of the special characteristics of this application.

Said plug presents a wide central bore to receive a ring gear for retention of the shaft or turning axle of the cylindrical bodies making up the hinge.

Figure 1:
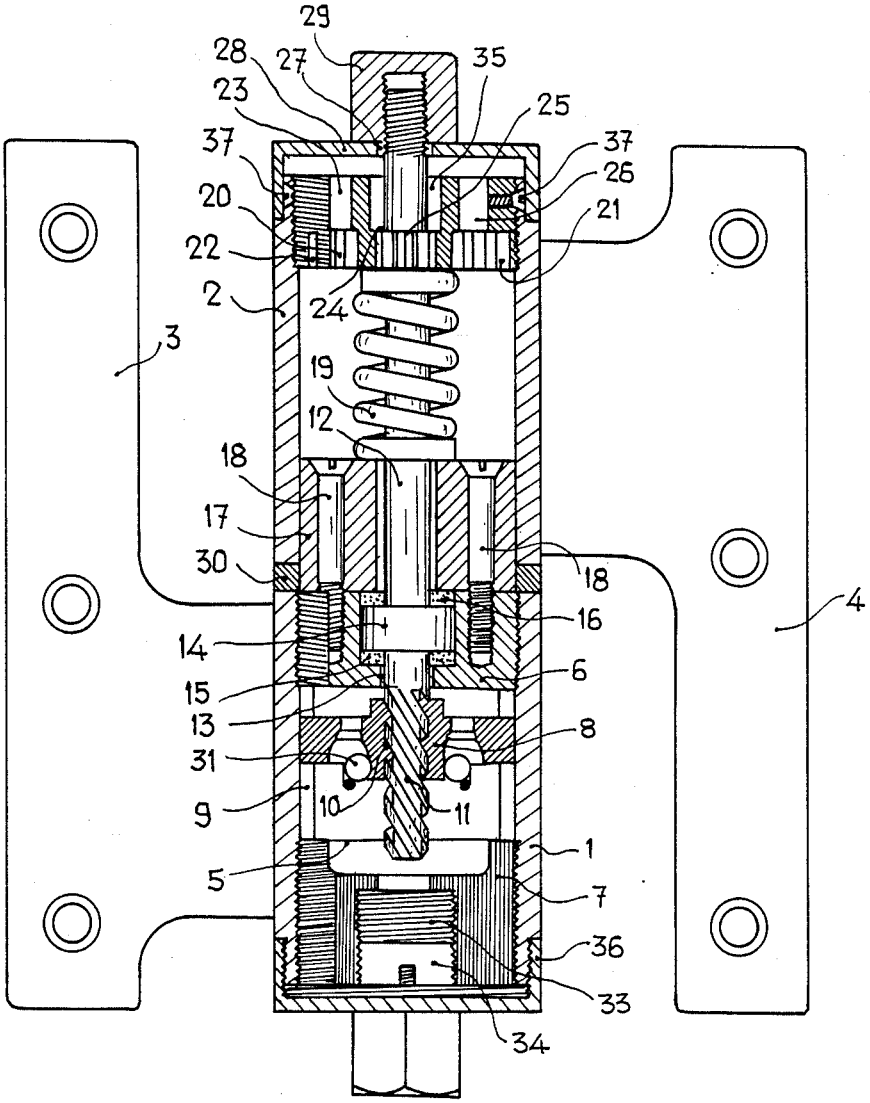
FIG. 1 shows a lateral elevation and longitudinal section of the hinge. In it, we find that the latter is formed externally by two cylindrical bodies coupled lengthwise by a friction washer, each of which extends laterally into a plate for fixation to the door, respectively the door frame. The lower cylindrical body is closed by two end plugs between which a water-tight chamber is formed, filled with an oil-hydraulic fluid, inside of which a piston is axially guided and displaced. Said piston has an axial threaded bore screwed into the end spindle of a central shaft which crosses the sealing plug and extends longitudinally until it projects from the upper end plug of the second cylindrical body. Close to said spindle, the shaft is equipped with a ring mounted in a seat on the sealing plug of the first cylindrical body. The shaft acts as journal for the second cylindrical body to turn on the first and then passes through a bushing associated with the sealing plug of the first cylindrical body, said bushing acting as sealing cap of the second cylindrical body. Mounted and welded to said bushing is the end of a torsion spring, the opposite end of which is joined to a ring gear with an external toothing which engages the internal grooving of the sealing plug. Said ring gear also has an inner toothing which engages a grooved ring of the central shaft, the latter passing through the faceted collar of the gear and projecting from the central perforation of the cap of said cylindrical body. The projecting end of the shaft is suitably threaded to be fitted with a nut which fixes the position of the shaft or axle of the first cylindrical body on the second.
Figure 2A:
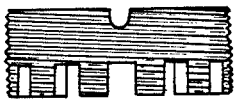
FIGS. 2*a* through 2*d* show a lateral elevation, top, bottom, and cross sectional view of the sealing plug for the second cylindrical body. In it, we see that said plug of cylindrical shape presents an external threading to screw into the lateral inner surface of the second cylindrical body. Said plug is equipped on one of its bases with a peripheral toothing, and among the teeth there are recesses designed to receive the external teeth of the ring gear which fixes the central shaft.
Figure 3A:
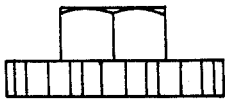
Figure 3B:
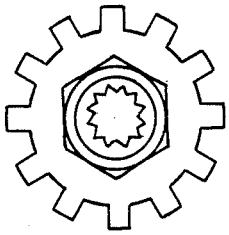
Figure 3C:
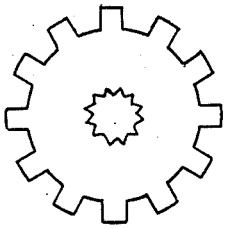
Figure 3D:
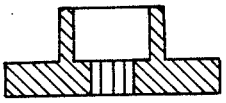

FIGS. 3*a* through 3*d* show a lateral elevation, top, bottom, and cross sectional view of the ring gear for fixation and retention of the central shaft. In it, we see that said ring gear presents an external toothing, which engages the recesses between the teeth of the sealing plug. The inner bore of the gear also has a toothing which engages the grooves of a ring on the central shaft. Said ring gear forms on one of its bases an externally- faceted collar, so that a socket wrench can be used on it after it has been loosened from its coupling with the sealing plug. One end of the torsion spring is welded to the opposite base of the ring gear.

Figure 4A:
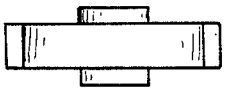
Figure 2B:
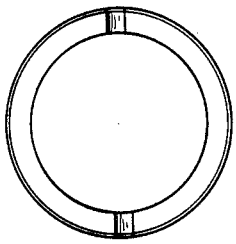
Figure 4B:
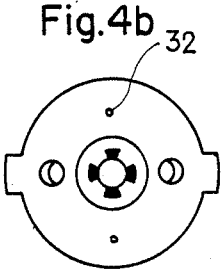
Figure 2C:
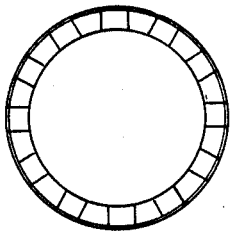
Figure 4C:
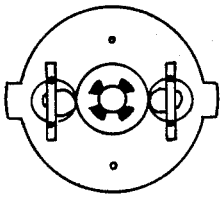
Figure 2D:
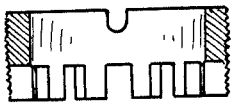
Figure 4D:
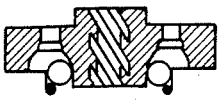

FIGS. 4*a* through 4*d* shows a side elevation, top, bottom, and sectional view of the piston mounted in the first cylindrical body of the hinge. In it, we see that the piston has a circular section which is diametrically lengthened into two opposite extensions lodged in internal longitudinal guides of the cylindrical body to prevent the piston from turning.

DESCRIPTION OF THE PREFERRED EMBODIMENTS

Said piston has a central bore with an inner helicoidal thread for mounting on the end spindle, which is part of the central shaft. Around said bore and in a diametrically opposed arrangement, the piston has some axial check valves which open one-way for passage of the fluid, while remaining closed in the opposite direction. In an orthogonal arrangement with said valves, the piston incorporates two small orifices which allow fluid to pass when the valves are closed.

Now that we have described the Figures making up the set of drawings, we shall enumerate the individual elements which constitute the object of this invention.

The spring hinge with damper is made up by two cylindrical bodies -1- and -2-, by means of their fixation plates -3- and -4- with the door, and respectively the door frame. The cylindrical body -1- forms a watertight chamber -5-, closed at the ends by sealing plugs 6- and -7- and enclosing a piston -8- equipped with diametrically opposed extensions running between longitudinal guides -9- of the cylinder to prevent said piston from rotating.

Said piston has a central threaded bore -10- by which it is mounted on a wide-pitch spindle -11-, said spindle being the end of axial shaft -12-.

Said axial shaft passes through a central perforation -13- in sealing plug -6- where it terminates in a seat for a retention ring -14- of said shaft between watertight joints -15 and -16-.

Said shaft passes, in turn, through a cylindrical bushing -17- anchored to said plug by means of anchoring organs -18-. Said bushing acts simultaneously as additional watertight seal and axial retention for the ring on the shaft, as a journal turning on the second body of said hinge and as anchor to which the end of a helicoidal spring -19-, mounted coaxial with said shaft, is welded.

The opposite end of said spring is welded to the disk of a ring gear -20-, the external toothing -21- of which engages the inner surface -22- of a sealing plug -23- at the end of the cylindrical body -2-.

The internal toothing -24- of said ring gear radially engages the grooved lateral surface of a ring -25- on the central shaft.

Said central shaft passes through the bore of the ring gear which is mounted in the wide bore -26- of the sealing plug, extending over the threaded end of the shaft through the central perforation -27- of a second axially acting plug -28- of the cylinder where it is fitted with an external nut -29-.

Said nut fixes the piston of the shaft, providing retention and axial mounting for cylindrical body -2- of the hinge on the journal of the cylindrical body -1-, an axial friction washer -30- being inserted between the two bodies.

Chamber -5- formed by cylindrical body -1- is filled with an oil-hydraulic fluid in which piston -8- is axially displaced. To this effect, some axial check valves -31- are provided in combination with some fine perforations -32-.

The capacity of said chamber can be regulated by means of a plunger -33- threaded to fit a central perforation -34- of the end sealing plug -7-.

Said sealing plug and end of cylindrical body -1- is closed on the outside by a counterplug -36- through which the faceted head of said plug passes in order to allow regulation of the volume in the chamber.

It has been provided that ring gear -20- be equipped with a collar -35-, faceted on the outside, which is mounted in the wide perforation -26- of sealing plug -23- fixed to the cylindrical body by means of upper bolts -37-. For access to said collar, the counterplug -28- is removed so that the tension of the torsion spring can be regulated with a suitable tool.

All this is so designed that the hinge is mounted on the door in a traditional way, screwing one plate to the frame and screwing the other - or welding it in case of metal doors - to the ege of the door.

Care must be taken that the hinge is mounted in a folded position, i.e. when the door is closed, in order to make the installment easy.

When the hinges are mounted, they operate as follows:

When the door is opened, the cylindrical body -2- of the hinge, plate -4- of which is fixed to the door, will turn above the cylindrical body -1-, plate -3- of which is anchored to the door- frame.

During said turn, spring -19- will load itself, while the central shaft -12- is turning, transmitting an axial upward displacement to piston -8- by the thread on spindle -11-.

In said upward displacement of the piston, valves -31- open, rapidly passing the oil hydraulic fluid to the lower area of the piston.

When the door is released, the force of the sping will try to slam it, inverting the turn of the shaft which will displace piston -8- downward.

In said downward displacement, the oil pressure will close valves -31- and they will act as check valves, while the resistance of the compressed oil will counter the force of the spring.

The oil will pass slowly through perforations -32- of the piston, checking the recovery of the tension in the spring and closing the door softly.

The force of the spring may weaken with advancing wear of the door, but the hinge then provides an efficient and easy system to regulate said force as desired.

To this effect, the upper nut -29- is removed and counterplug -28- taken off, operations which must be carried out with the door closed.

Once the plug is removed, the faceted collar -35- of the ring gear can be reached with a suitable tool, said gear to be pushed down first by hand to extract it from the grooves of sealing plug -23-.

Once the ring gear has been released from its engagement, the wrench may be given as many turns as desired to tighten the spring, taking care that the teeth of gear -20- are restored to the recesses or grooves -22- in the sealing plug.

By the same token, if the spring has sufficient force to close the door very rapidly or slam it, the oil volume in the chamber may be regulated to cure these defects. For this purpose, the lower counterplug -36- must be unscrewed. When plunger -33- is given a turn to the left, the door closes faster - when the plunger is turned or screwed to the right, the door will close more slowly.

Having made the description in the above specifications, we must insist that the details of embodiment of the idea therein exposed may vary, i.e., there might be small alterations - always based on the fundamental principles of the idea which are essentially those reflected in the above specifications.

I claim:

1. A hinge assembly with means for attachment between a door and a door frame, said assembly containing damper means comprising:

a first body of cylindrical shape;

an axial shaft passing through said first body;

a coiled spring surrounding said axial shaft and generally attached to said first body;

a second body of cylindrical shape having a first end and a second end opposite said first end, said second body axially and rotatably anchored at said first end on said first body;

a hydraulic chamber for containing a hydraulic fluid, said chamber being positioned in said second body, said hydraulic chamber comprising a first closure cap disposed inside said second cylindrical body close to said first end, said first closure cap defining a first central perforation in its surface through which said axial shaft passes; and a second closure cap disposed inside said second cylindrical body near said second end; and piston means associated with said chamber and comprising a section slidably held within said chamber and a spindle generally attached to said axial shaft and threadably received in said section, said section defining at least one inlet hole in its surface such that the automatic closing motion of the door is dampered by the turning of said first body resulting in the decompression of said spring causing said axial shaft and therefore said spindle to turn this resulting in said section axially moving along the length of said chamber while being resisted by said hydraulic fluid, said hydraulic fluid passing through said inlet hole, said spindle comprising an axial retention ring rotatably mounted on said axial shaft where said shaft passes through said first central perforation of said first closure cap such that said ring acts as a pivot for said rotation of said first cylindrical body, at least one coupling mounted on said axial shaft next to said retention ring;

at least one longitudinal guide located between said section and the interior of said second cylyndrical body, such that said longitudinal guide hinders rotation of said section, said piston means further comprising at least one, unidirectional outlet bypass valve comprised of a ball and a generally open housing, such that during the opening motion of the door, said coiled spring is compressed forcing said shaft to turn and therefore said section to ascend and displace said hydraulic fluid by forcing it to pass through said outlet bypass valve; and a cylindrical bushing mounted on said axial shaft and providing anchoring means for said cylindrical bodies, said assembly, said cylindrical bushing facilitating oil tightness of said hinge assembly, complementing axial retention of said ring and providing anchoring means for said coiled spring surrounding said axial shaft by means of welding.

2. The hinge assembly as claimed in claim 1, wherein said second cylindrical body further comprises a faceted piston cap threadably connected to said second closure cap so that said piston cap regulates the volume of said hydraulic chamber to achieve a desired closing speed of the door.

3. The hinge assembly as claimed in claim 2, further comprising a first counter cap threadably connected to said second end of said second cylindrical body and defining a central perforation through which said faceted piston cap passes.

4. The hinge assembly as claimed in claim 3, wherein said first cylindrical body further comprises:

a third closure cap mounted on said axial shaft at an end of said first cylindrical body opposite said first end of said second cylindrical body, said third closure cap defining a central perforation and a plurality of peripheral slots in said axial shaft's direction.

a circular crown shaped disc defining a grooved central opening, said disc being rotatably mounted on said axial shaft and welded to said coiled spring, said disc having a plurality of lateral peripheral teeth coupling with said slots, and an externally faceted neck located generally centrally of said disc and being integral therewith; and a second ring mounted on said axial shaft and having a plurality of axial grooves on its outside surface, said grooves coupling with said grooves of said disc, such that said disc can be pressed down and disengaged from said ring and said slots so as to change the torsion of said coiled spring without disassembly of said hinge assembly.

5. The hinge assembly as claimed in claim 4, wherein said disc and said ring are disposed in said perforation of said third closure cap.

6. The hinge assembly as claimed in claim 5, wherein said first, second, and third closure caps are threadably secured in their respective postions.

7. The hinge assembly as claimed in claim 6, further comprising a second counter cap defining a central perforation, said counter cap threadably secured to said second cylindrical body to cover said third closure cap.

8. The hinge assembly as claimed in claim 7, wherein said axial shaft has a threaded end extending through said central perforation of said second counter cap.

9. The hinge assembly as claimed in claim 8, further comprising an external nut retaining said threaded end of said axial shaft so that pivotal rotation of said second cylindrical body is hindered.

10. The hinge assembly as claimed in claim 9, further comprising an axial friction washer interposed between said first and said second cylindrical bodies to provide smoother operation of the hinge.

11. The hinge assembly as claimed in claim 1, wherein said section slides along the entire length of said chamber as said door closes.

* * * * *